United States Patent [19]

Hutter et al.

[11] 4,370,015

[45] Jan. 25, 1983

[54] COAXIAL TAP CONNECTOR

[75] Inventors: Harold G. Hutter, Brookfield; Leonard J. Francis, Waterbury, both of Conn.

[73] Assignee: Bunker Ramo Corporation, Oak Brook, Ill.

[21] Appl. No.: 222,846

[22] Filed: Jan. 6, 1981

[51] Int. Cl.[3] ..... H01R 13/40

[52] U.S. Cl. ..... 339/97 P; 339/99 R

[58] Field of Search ..... 339/198 H, 198 J, 97 R, 339/97 P, 98, 99 R, 100, 97 L, 99 L

[56] References Cited

U.S. PATENT DOCUMENTS

| | | | |
|---|---|---|---|
| 1,373,838 | 4/1921 | Scoppola | 339/97 P |
| 2,805,399 | 9/1957 | Leeper | 339/177 E X |
| 2,896,186 | 7/1959 | Hardmark | 339/100 |
| 3,308,421 | 3/1967 | White | 339/196 R |
| 3,543,222 | 11/1970 | Rheinfelder | 339/99 R |
| 3,611,263 | 10/1971 | Knone | 339/97 R |
| 3,989,400 | 11/1976 | Smith | 339/100 X |
| 4,080,034 | 3/1978 | Werner | 339/98 |
| 4,120,554 | 10/1978 | Bianchi | 339/97 P |
| 4,261,632 | 4/1981 | Narozny | 339/100 X |
| 4,266,842 | 5/1981 | Dillon et al. | 339/97 P |

*Primary Examiner*—John McQuade
*Assistant Examiner*—John S. Brown

[57] ABSTRACT

An electrical connector includes a connector body having a U-shaped alignment cavity configured for snugly receiving a coaxial cable and an elongate contact extending into the cavity from a point disposed along the base thereof, the contact being adapted for piercing an intact portion of a coaxial cable received within the alignment cavity for making electrical connection with the central conductor of the cable. A pair of additional contact members extend into the alignment cavity and are adapted for piercing intact portions of the coaxial cable for making electrical connection with the conductive braid encircling the central conductor. Movement of the central conductor away from the elongate contact is inhibited by a cable piercing head of the contact and can be further precluded by a plunger which abuts the central conductor directly opposite the elongate contact.

3 Claims, 11 Drawing Figures

COAXIAL TAP CONNECTOR

CROSS REFERENCE TO RELATED APPLICATION

This relates to application Ser. No. 180,278 filed Aug. 22, 1980.

BACKGROUND OF THE INVENTION

The present invention relates generally to electrical connectors and, in particular, to an electrical connector for establishing an electrical tap connection to the inner conductor of an unbroken coaxial cable and for reliably maintaining the established tap connection.

Coaxial cable is commonly used to interconnect a variety of electronic devices largely because of its low loss and high shielding characteristics. For example, many computer systems are frequently interconnected by unbroken lengths of such cables. It often becomes necessary, however, to tap an unbroken length of coaxial cable connected between two electronic devices in order to enable the operation of an additional device in response to the signals transmitted over the cable. Thus, one or more additional terminals or computers may be added to a computer system in this manner.

In the past, unbroken lengths of coaxial cable have been tapped by cutting the cable and installing a tee connector between the cut ends, the central leg of the connector being adapted for mating with a branch cable whose other end is connectable to, in the case of the foregoing example, an additional computer terminal. This operation is relatively time consuming requiring the use of at least semi-skilled personnel and assembly tools. In addition, while the cable is cut and for the period of time that it takes to install the tee connector, the complete computer system may be taken out of service. Also, if at some later time it is desired to remove the installed tee connector, the cut cable must either be spliced together which frequently degrades the signal transmission characteristics of the cable or, alternatively, a new cable must be provided.

U.S. Pat. No. 2,805,399 to Leeper discloses a tee type connector which can be used for tapping a coaxial cable but does not require the cable to be cut during the installation procedure. In a preliminary step to the installation of the connector taught in this patent, a continuous radial opening or channel is formed between the central conductor and exterior surface of a coaxial cable. The connector is then installed by guiding a spring loaded conductor stem into the channel for making electrical connection with the cable central conductor while connection is made with the conductive braid surrounding the central conductor by rotating a tapered screw which penetrates the cable and presses firmly against the conductive braid.

Factors such as thermal variations and other stresses imposed on the coaxial cable comprise a major consideration affecting the design of connectors of the type described above. For example, thermal variations in a cable may cause movement of the contact portions of the connector relative to the cable conductors thereby breaking a previously established electrical connection. In order to minimize the possibility of this occurring, the connector design preferably should include apparatus inhibiting any motion between the contact portions of the connector and the cable conductors, which motion could degrade the electrical connection established therebetween.

It is a basic object of the present invention to provide an improved connector assembly for tapping a coaxial cable, which connector assembly may be easily installed without any installation tools or the like and without requiring the performance of any preliminary cable conditioning steps.

It is a further object of the invention to provide a connector assembly of the foregoing type wherein an extremely secure connection is effected with the cable conductors, both mechanically and electrically, and wherein the connector assembly may be removed from the cable without degrading the cable's signal transmission characteristics.

It is a still further object of the invention to provide a connector assembly of the foregoing type wherein an established connection may be reliably maintained and may be readily disconnected when so desired.

SUMMARY OF THE INVENTION

In furtherance of the foregoing and other related objects, an electrical connector is provided wherein a secure electrical and mechanical connection is made with the central conductor of a coaxial cable by using only finger pressure and wherein no preliminary cable conditioning steps or special tools are needed to effect the connection.

The electrical connector of the present invention is adapted for use with a coaxial cable of the type having a central conductor encircled by an outer conductor and, in accordance with the principles of the present invention, broadly comprises first contact means adapted for piercing an intact portion of the coaxial cable and making electrical connection with the central conductor and readily emplaced plunger means adapted for piercing the coaxial cable and engaging the central conductor opposite the first contact means to preclude movement of the central conductor away from the first contact means. The connector also includes second contact means for making electrical connection with the outer conductor, and means are provided for aligning the first contact means and the central conductor to facilitate the establishment of the electrical connection therebetween.

In a preferred embodiment of the invention, the connector includes a body assembly having a generally U-shaped alignment cavity configured for snugly receiving the coaxial cable and an elongate contact extending into the cavity from the base thereof. The U-shaped alignment cavity aligns the central conductor and the elongate contact to facilitate the establishment of an electrical connection therebetween, and the elongate contact is adapted for piercing an intact portion of the cable and making electrical connection with the central conductor of the cable. The elongate contact includes a generally conically shaped cable piercing head which functions as a barb to inhibit separation of the elongate contact and the central conductor. Electrical connection is made with the outer conductor encircling the central conductor of the cable by additional contact means which extend into the U-shaped alignment cavity from the base thereof and engage the coaxial cable. The body assembly is secured within a cover having a recessed portion with opposed slide tracks and adapted to compress the coaxial cable within the U-shaped alignment cavity. A plunger having a pin at one end and a head portion at the other end is inserted through the cover to penetrate the coaxial cable with the pin abutting the central conductor. The head portion is rotatable in the cover recessed portion to engage the slide tracks over at least a portion of its rotation to secure the pin in abutment with the central conductor.

BRIEF DESCRIPTION OF THE DRAWINGS

Further objects and advantages of this invention will be apparent from reading the following specification in conjunction with the drawings in which.

DESCRIPTION OF THE PREFERRED EMBODIMENT

Figure 1:
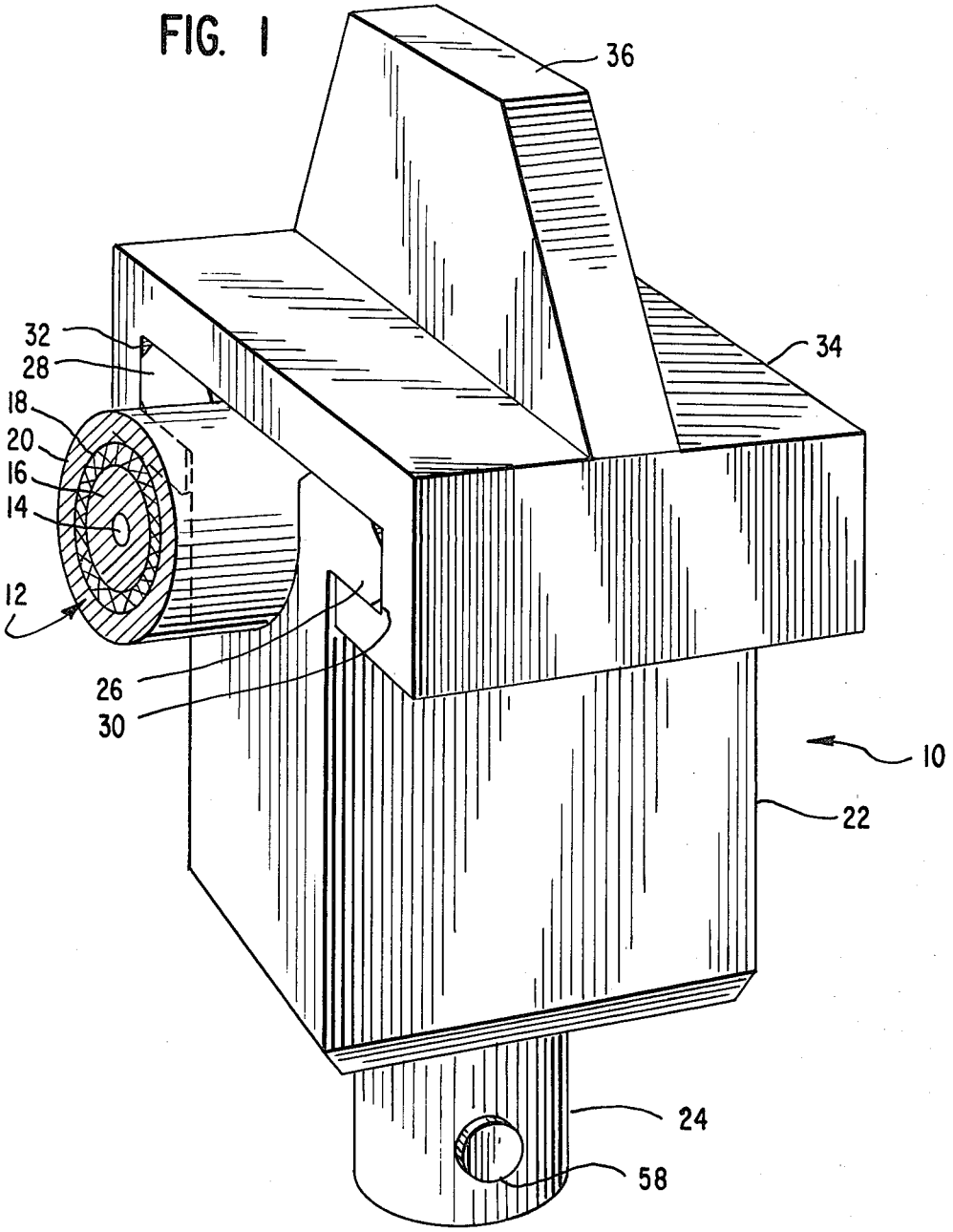
FIG. 1 is a perspective view of the connector assembly of the invention described in the aforementioned related application, as installed on a coaxial cable.

FIG. 1 illustrates one embodiment of an electrical connector 10 constructed in accordance with the invention, described in the aforementioned related application, the connector being shown assembled in mating relationship with a coaxial cable 12. Coaxial cable 12 conventionally consists of an inner central conductor 14 surrounded by a dielectric insulating layer 16 which, in turn, is surrounded by an outer conductive shield 18 commonly consisting of a metallic braid. An outer flexible insulating material 20, frequently referred to as a cable jacket, covers the outer conductive shield. Dielectric layer 16 may consist of a variety of materials such as a foam dielectric incorporating a cellular material as is frequently found in coaxial cables used to interconnect computer systems. Connector 10 makes electrical connection with the central conductor and the outer conductive shield of coaxial cable 12 and comprises a connector body 22 which terminates, for example, in a standard female "BNC" jack 24. Connector body 22 also includes a pair of opposed rails 26 and 28 mating in sliding engagement with a pair of corresponding slide tracks 30 and 32 of a connector cover 34. Connector cover 34, which includes a slide handle 26, forms a snug fit with connector body 22 to protect the electrical connection made with cable 12 from external influences. While the connector body is preferably constructed of a metallic material, the connector cover may be formed from a suitable plastic or the like.

Figure 4:
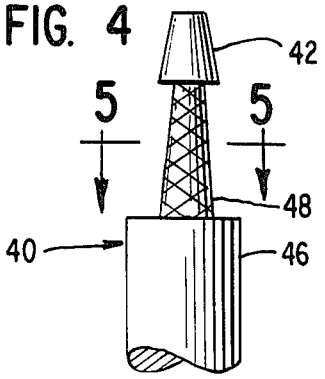
FIG. 4 is an enlarged elevational view showing the central conductor contact of the connector assembly of FIG. 1.
Figure 5:
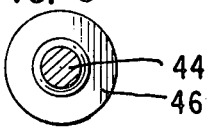
FIG. 5 is a sectional view taken along line 5—5 of FIG. 4.
Figure 2:
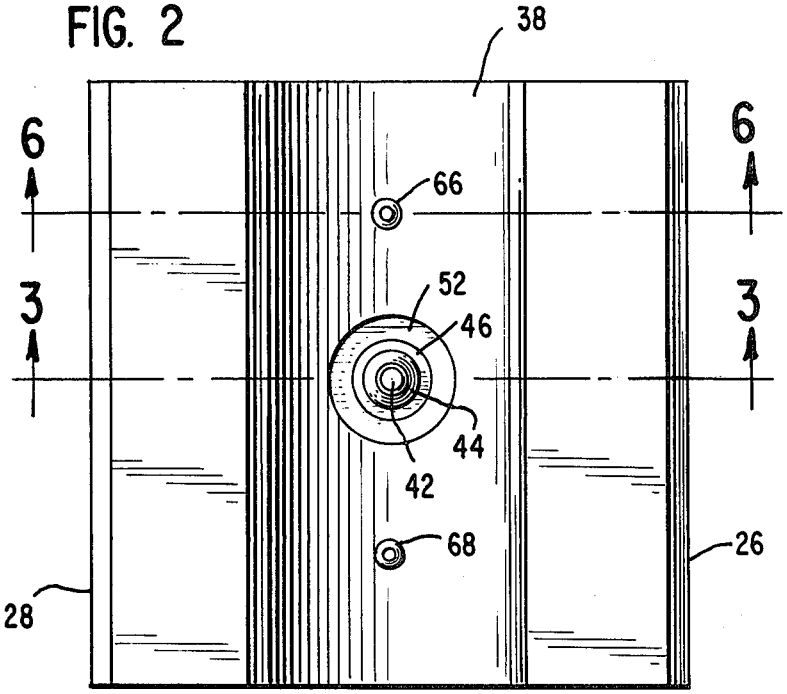
FIG. 2 is a top plan view of the body of the connector assembly shown in FIG. 1 with the cover thereof removed.
Figure 3:
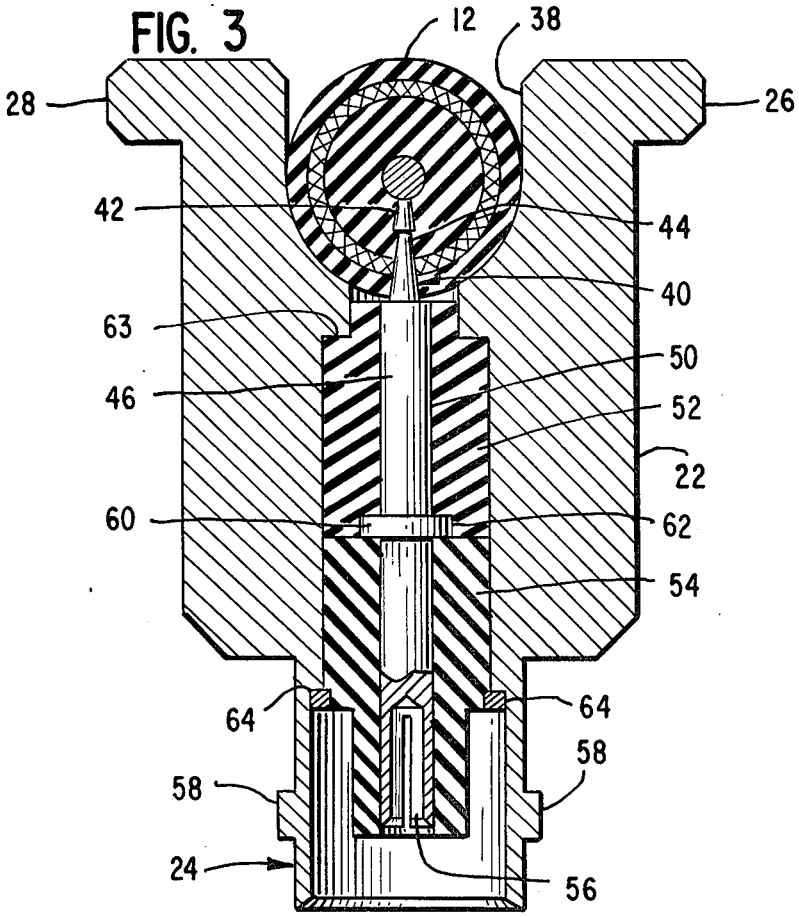
FIG. 3 is a sectional view taken along line 3—3 of FIG. 2.

Referring to FIGS. 2 and 3, connector body 22 has a longitudinally extending, U-shaped alignment cavity 38 configured for snugly receiving coaxial cable 12. Therefore, when cable 12 is seated within the alignment cavity, the longitudinal axis of central conductor 14 is fixed in a central orientation within the cavity and vertically spaced from the lowermost surface thereof. An elongate electrical contact 40 extends centrally through the connector and upwardly into alignment cavity 38. As shown in detail in FIGS. 4 and 5, contact 40 comprises a generally conically shaped cable piercing head 42 at the end of a tapered contact portion 44 which extends into alignment cavity 38 from an inner contact portion 46. Due to the positional relationship of contact 40 relative to alignment cavity 38 of connector body 22, the seating of coaxial cable 12 within the alignment cavity will result in contact 40 piercing cable jacket 20, outer conductor 18, dielectric layer 16 and making electrical connection with central conductor 14 of the cable. Moreover, due to the construction and dimensions of contact 40, the smallest transverse dimension of cable piercing head 42 preferably being on the order of 0.008 to 0.010 inches, only downward finger pressure on cable 12 is required to enable contact 40 to penetrate the cable. In addition, as a result of the cold flowing of dielectric layer 16 around contact 40, cable piercing head 42 acts as a barb for inhibiting the contact from backing away or being withdrawn from the central conductor 14 when, for example, cable 12 is subjected to thermal changes. Also, as shown in FIGS. 4 and 5, tapered contact portion 44 of contact 40 includes an insulating jacket 48 which may comprise an epoxy coating or other suitable insulation material for preventing the formation of an electrical connection between the contact and outer conductor 18 of coaxial cable 12.

Inner contact portion 46 of contact 40 extends through and is captivated within a bore 50 formed in a front dielectric insert 52 and an abutting rear dielectric insert 54, the dielectric inserts preferably comprising a copolymer of styrene to isolate the inner contact portion from metallic connector body 22. In the particular embodiment shown in the drawings, the inner contact portion of contact 40 terminates in a conventional female contact 56 of BNC jack 24 which also includes a pair of conventional bayonet pins 58 to facilitate mating with a complementary BNC plug. An annular flange of the contact is retained within a corresponding recess 62 formed in front dielectric insert 52 to inhibit sliding movement of the contact within bore 50 especially when a male contact (not shown) is joined with or removed from female jack 24. An annular shoulder 63 in the connector body engages front dielectric insert 52 and a retaining ring 64 encircles the rear dielectric insert 54 to capture the dielectric inserts in the connector body.

Figure 6:
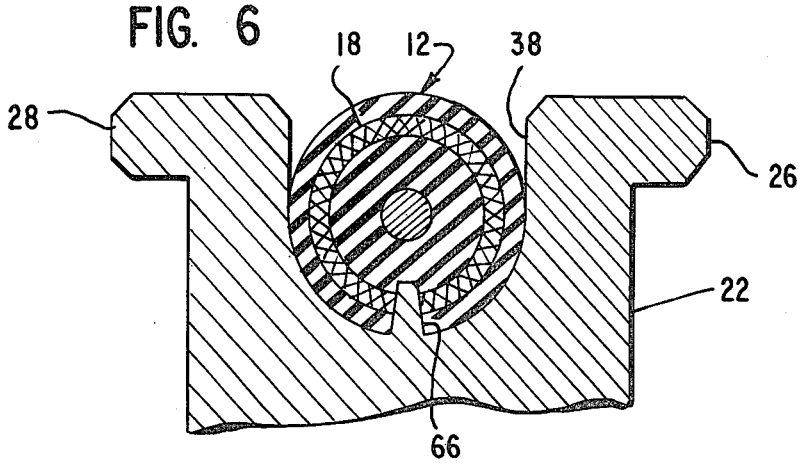
FIG. 6 is a sectional view taken along line 6—6 of FIG. 2.

Referring to FIGS. 2 and 6, a pair of pin-like contact members 66 and 68, each forming an integral part of connector body 22, also extend upwardly into alignment cavity 38 to make electrical connection with outer conductor 18 of cable 12. Contact members 66 and 68, which are disposed in longitudinal alignment with and on opposite sides of contact 40 along the lowermost surface or base of alignment cavity 38, are also adapted for piercing, under finger pressure, a coaxial cable seated within the cavity. These contact members are, however, somewhat shorter than contact 40 such that the two contacts penetrate cable jacket 20 and outer conductor 18 but only slightly into dielectric layer 16. In this manner, contact members 66 and 68, and thereby metallic connector body 22, make electrical connection only with outer conductor 18, this electrical connection being communicated by the connector body to BNC jack 24.

Figure 7:
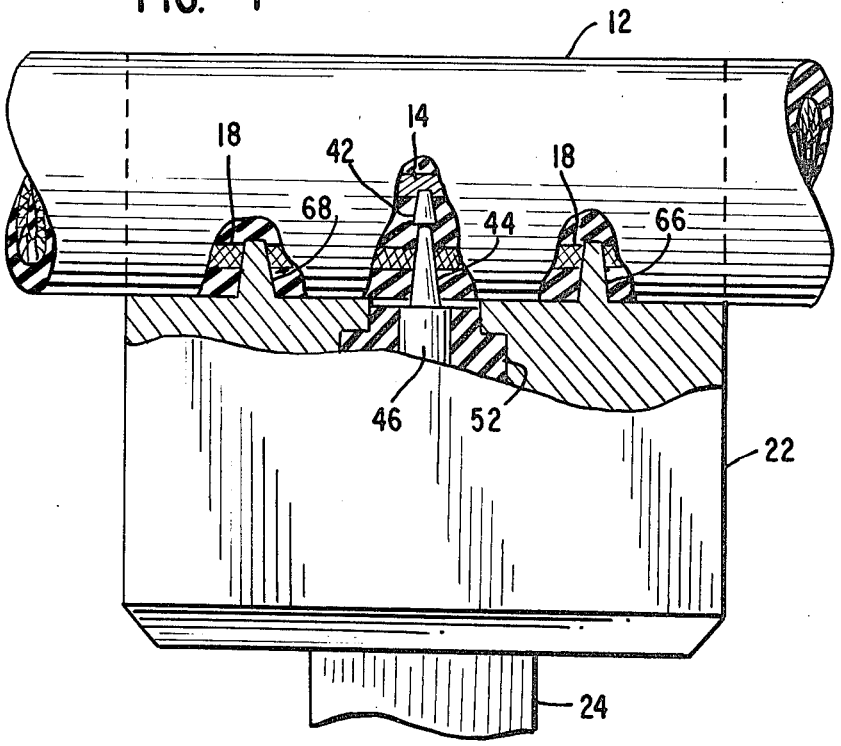
FIG. 7 is a partially broken elevational view showing the contacts of the connector assembly of FIG. 1 making electrical connection with a coaxial cable.

In order to install connector 10 to an intact or unbroken portion of coaxial cable, i.e. a portion of cable which has not been subjected to any preliminary steps, the coaxial cable is placed within U-shaped alignment cavity 38 and firmly pressed down into the cavity using only finger pressure. As a result, the upstanding tapered contact portion 44 of contact 40, including cable piercing head 42, pierces cable 12 and makes electrical connection with the central conductor 14 while contact members 66 and 68 pierce the cable and make electrical connection with outer conductor 18. The complete electrical connection of connector 10 and coaxial cable 12 is best illustrated in FIG. 7. As mentioned previously, the barb-like configuration of cable piercing head 42 facilitates penetration into the cable and inhibits the contact from backing away from the central conductor of the cable while the insulative coating of jacket 48 prevents a short circuit between contact 40 and the outer conductor 18. In addition to making electrical connection with outer conductor 18 of cable 12, contact members 66 and 68 also tend to inhibit unwanted lateral movement between coaxial cable 12 and connector body 22. As described above, the electrical connection made by contact members 66 and 68 to the outer conductor of cable 12 is communicated to jack 24 through metallic connector body 22 while the electrical connection of contact 40 to central conductor 14 is communicated to female contact 56 through inner contact portion 46 of contact 40.

After electrical connection has been made to the coaxial cable, as described above, connector cover 34 is positioned such that slide tracks 30 and 32 are in alignment with rails 26 and 28 of the connector body. The cover is then slid in place as shown in FIG. 1 to capture and slightly compress cable 12 within alignment cavity 38. This completes the assembly of the connector to the cable and enables electrical signals to be transmitted from cable 12 to a branch cable when a mating BNC plug engages jack 24. Should subsequent removal of the connector 10 become necessary, connector cover 34 is simply removed from connector body 22 and cable 12 is lifted from the alignment cavity. The signal transmission characteristics of the coaxial cable are not noticeably degraded by this removal operation since only three small pinholes remain in the cable removal area. Also, the barb-like configuration of cable piercing head 42 does not significantly obstruct the removal operation.

In a preferred embodiment of the present invention illustrated in FIGS. 8–11, cover **34*a* is adapted to hold a plunger, indicated generally by reference numeral 70, which precludes movement of cable central conductor 14 away from elongate contact 40. As will be seen from the following description, the foregoing is achieved by aligning plunger 70 with elongate contact 40 of the connector on opposite sides of central conductor 14** of the coaxial cable.

Figure 8:
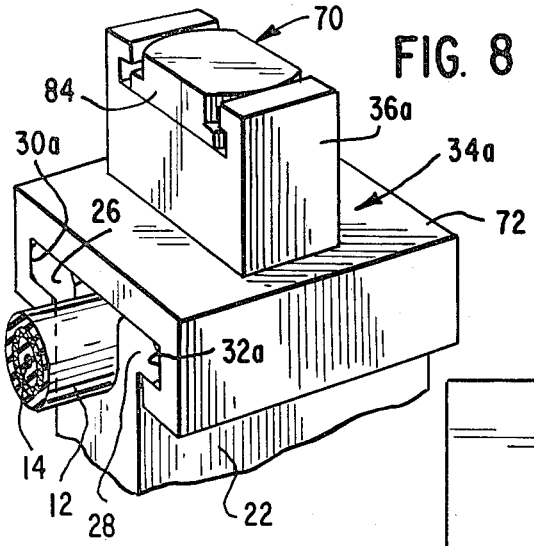
FIG. 8 is a perspective view of the connector assembly of the present invention which includes means utilizing a plunger for precluding movement of the central conductor of a coaxial cable.
Figure 9:
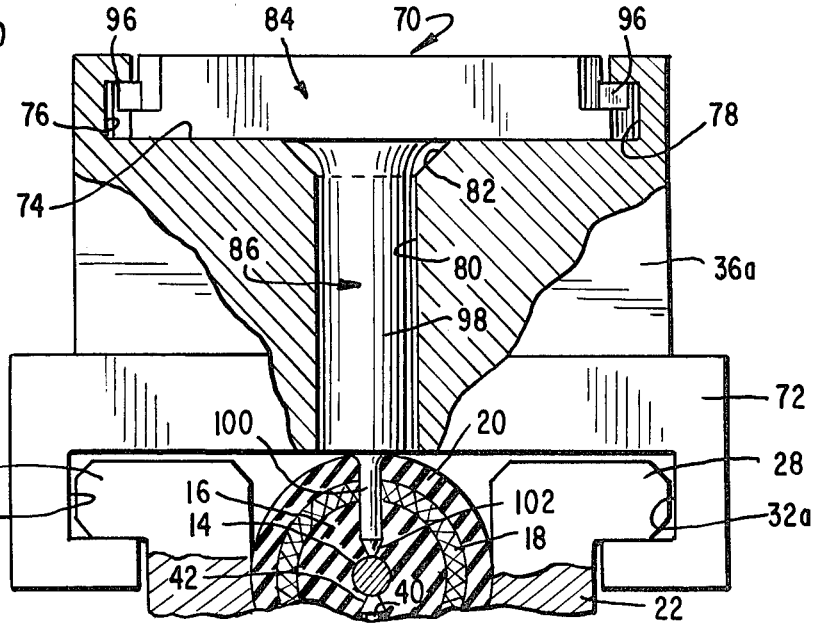
FIG. 9 is a front elevational view of the connector assembly of FIG. 8, partially broken away to show the plunger engaging the central conductor of a coaxial cable.

With reference to FIGS. 8 and 9, cover **34*a* comprises a base 72 and an integral upstanding handle 36*a*. As in the illustrations of FIGS. 1–7, a pair of opposed slide tracks 30*a* and 32*a* depend from base 72 and mate in sliding engagement with rails 26 and 28 of connector body 22 when cover 34*a* is installed on the connector body. In the present invention, however, handle 36*a* further includes a rectangularly shaped recess 74 in which plunger 70 is received and a pair of opposed slide tracks 76 and 78 along the shorter sides of the recess for retaining the plunger therein. As best seen in FIG. 9, a cylindrical bore 80 extends through handle 36*a* and base 72 of cover 32*a*, the bore having a flared opening 82 and being centrally located in recess 74. Accordingly, when cover 34*a* is installed on connector body 22, bore 80 is located in alignment with the longitudinal axis of contact 40**.

Figure 10:
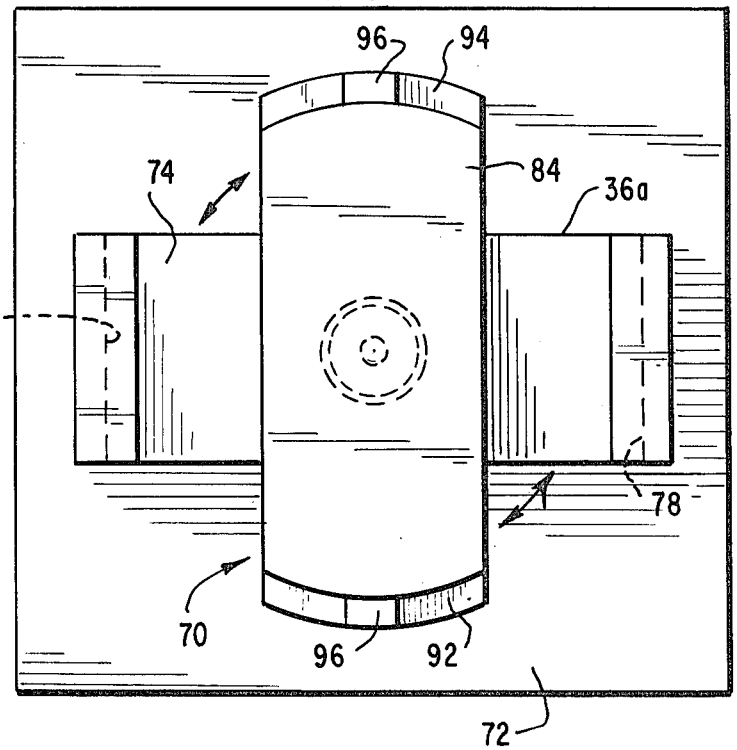
FIG. 10 is a plan view of the connector assembly of FIG. 8 prior to final installation of the plunger.
Figure 11:
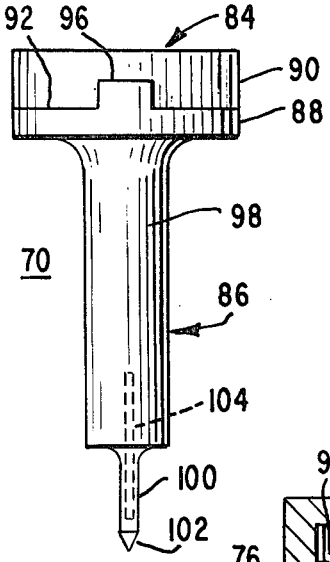
FIG. 11 is a side elevational view of the plunger.

With additional reference to FIGS. 10 and 11, plunger 70, which is preferably a unitary structure molded of plastic or the like, comprises a head 84 and a depending elongate shank 86. Head 84 comprises a generally rectangular plate-like base 88 whose opposed shorter sides are arched and which is configured to be snugly received within recess 74 of the handle. The top portion 90 of base 88 is similarly shaped, but is somewhat shorter, forming a pair of ledges 92 and 94 at each end of base 88. An ear 96 is also formed on each ledge, 92 and 94, the ears each extending upwardly to engage slide tracks 76 and 78, respectively, when plunger 70 is installed in cover **34*a*. The depending shank of plunger 70 comprises a cylindrical portion 98 extending centrally from the lower surface of base 88 and having a diameter slightly smaller than the diameter of bore 80 and a length equal to or slightly less than the length of bore 80. A pin 100 having a tapered head portion 102 depends coaxially from cylindrical portion 98 and includes a thin stiffener pin 104** embedded therein.

In use, cover **34*a* is first installed on the connector by guiding slide tracks 30*a* and 32*a* of the cover into sliding engagement with rails 26 and 28 of connector body 22, and as a result, bore 80 of cover 34*a* is disposed in substantial alignment with contact 40 of the connector. Next, plunger 70 is installed by inserting shank 86 into bore 80 with the longitudinal axis of head 84 offset from the longitudinal axis of handle 36*a* by approximately 90° as illustrated in FIG. 10. The plunger is then pressed downwardly, causing pin 100 to penetrate jacket 20, outer conductor 18 and dielectric layer 16 of cable 12. In this position, the lower surface of base 88 of the plunger is seated in recess 74 and head portion 102 of pin 100 abuts central conductor 14 directly opposite central contact 40 of the connector to thereby preclude movement of the central conductor away from contact 40. Installation of the plunger is completed by rotating the head 84 either in a clockwise or counter-clockwise direction until its longitudinal axis is in alignment with the longitudinal axis of handle 36*a* as illustrated in FIGS. 8 and 9. As head 84 is rotated, thereby also rotating contiguous shank 86 about its longitudinal axis, annular ledges 92 and 94 enter opposed slide tracks 76 and 78 with the top surfaces of ears 96 frictionally engaging the slide tracks to secure the plunger in handle 36*a***.

It will thus be appreciated that the connector of the present invention may be installed on a coaxial cable without any preliminary cable conditioning operations, such as cutting or the like, and without the use of any special installation tools, crimping or soldering. System down time is thereby completely eliminated when installing the connector. In addition, due to the barb-like configuration of the cable piercing head of the elongate contact, and due to the fact that the cable is captured and slightly compressed within the U-shaped alignment cavity, a highly reliable connection, both mechanically and electrically, is achieved. Movement of the central conductor away from the contact is precluded by utilization of means such as a plunger opposite the contact.

While a particular embodiment of the invention has been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

What is claimed is:

1. An electrical connector for use with a coaxial cable of the type having a central conductor encircled by a dielectric support structure and an outer conductor comprising:

a body assembly having a generally U-shaped alignment cavity configured for snugly receiving said coaxial cable;

an elongate contact having a generally conically shaped cable piercing head and extending into said U-shaped alignment cavity from the base thereof, said cable piercing head being adapted for piercing an intact portion of said coaxial cable received in said cavity and engaging said central conductor for making electrical connection therewith, the base of said cable piercing head being larger than the adjacent portion of said elongate contact for engaging said dielectric support structure and inhibiting separation of said cable piercing head and said central conductor;

first and second contact elements each adapted for piercing an intact portion of said coaxial cable received in said cavity and penetrating said outer conductor for making electrical connection therewith, said first and second contact elements extending into said U-shaped alignment cavity from the base thereof and being spaced on either side of said elongate contact;

cover means configured for securement to said body assembly and adapted for compressing said received coaxial cable within said U-shaped alignment cavity;

plunger means adapted for piercing said coaxial cable and engaging said central conductor directly opposite said cable piercing head to further preclude movement of said central conductor away from said cable piercing head, and wherein said cover means includes means for securing said plunger means in abutment with said central conductor;

said plunger means including a head portion and a shank portion and said cover means including a bore extending therethrough for receiving said shank portion therein, said bore being aligned with said elongate contact, when said cover means are secured to said body assembly, to effect abutment of said shank portion against said central conductor; and said cover means including a recessed portion for receiving said head portion, said recessed portion having a pair of opposed slide tracks and said head portion being rotatable in said recessed portion to engage said slide tracks over at least a portion of its rotation to secure said plunger means in said cover means.

2. An electrical connector for use with a coaxial cable of the type having a central conductor encircled by a dielectric support structure and an outer conductor comprising:

a body assembly having a generally U-shaped alignment cavity configured for snugly receiving said coaxial cable;

an elongate contact extending into said U-shaped alignment cavity from the base thereof and adapted for piercing an intact portion of said coaxial cable and making electrical connection with said central conductor;

said U-shaped alignment cavity aligning said elongate contact and said central conductor to facilitate the establishment of said electrical connection therebetween;

contact means extending into said U-shaped alignment cavity and adapted for piercing an intact portion of said coaxial cable received in said cavity and making electrical connection only with said outer conductor;

plunger means including an elongated shank portion having a pin at one end and a head portion at the other end, said pin adapted for piercing said coaxial cable and engaging said central conductor directly opposite said elongate contact to preclude movement of said central conductor away from said elongate contact, and cover means mountable on said body assembly; and said cover means including a recessed portion for receiving said head portion, said recessed portion having a pair of opposed slide tracks and said head portion being rotatable in said recessed portion to engage said slide tracks over at least a portion of its rotation to secure said pin in abutment with said central conductor.

3. In an electrical connector for use with a coaxial cable of the type having a central conductor encircled by an outer conductor, and including a body assembly having a first contact adapted for piercing an intact portion of the coaxial cable and making electrical connection with the central conductor when the coaxial cable is inserted in the body assembly, means for aligning the first contact with the central conductor to facilitate the establishment of said electrical connection, a second contact adapted for making electrical connection with the outer conductor, and a plunger having a tip at one end adapted for piercing the coaxial cable and engaging the central conductor opposite the first contact to preclude movement of the central conductor away from the first contact, the improvement comprising:

a cover adapted for mounting on said body assembly and including a bore extending therethrough for receiving said plunger tip, and a recessed portion having a pair of opposed slide tracks; and said plunger including a head portion insertable into said cover recessed portion when said plunger tip is extended through the cover bore to engage the central conductor, said plunger head portion being rotatable in said cover recess to engage said slide tracks over at least a portion of its rotation to secure said plunger tip in abutment with said central conductor.

* * * * *